US010371104B2

(12) United States Patent
Baek et al.

(10) Patent No.: US 10,371,104 B2
(45) Date of Patent: Aug. 6, 2019

(54) FUEL REFORMING SYSTEM AND CONTROL METHOD OF COOLANT SUPPLY

(71) Applicants: HYUNDAI MOTOR COMPANY, Seoul (KR); KIA MOTORS CORPORATION, Seoul (KR)

(72) Inventors: Hong Kil Baek, Seoul (KR); Seung Woo Lee, Seoul (KR); Tae Won Lee, Incheon (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 97 days.

(21) Appl. No.: 15/783,726

(22) Filed: Oct. 13, 2017

(65) Prior Publication Data

US 2018/0298854 A1 Oct. 18, 2018

(30) Foreign Application Priority Data

Apr. 18, 2017 (KR) ..... 10-2017-0049811

(51) Int. Cl.
*F01P 3/20* (2006.01)
*F02B 43/10* (2006.01)
(Continued)

(52) U.S. Cl.
CPC ..... *F02M 26/33* (2016.02); *F01P 3/20* (2013.01); *F02B 43/10* (2013.01); *F02M 26/02* (2016.02);
(Continued)

(58) Field of Classification Search
CPC .... F02B 43/10; F02B 43/12; F02B 2043/103; F02B 2043/106; F02M 26/00–74
See application file for complete search history.

(56) References Cited

U.S. PATENT DOCUMENTS 6,732,942 B1 * 5/2004 Sangwan ..... B60H 1/00885 123/142.5 E
9,745,887 B2 * 8/2017 Honda ..... F02G 5/00
(Continued)

FOREIGN PATENT DOCUMENTS

JP 2006037745 A * 2/2006 ..... F02M 26/07
JP 2009-196530 A 9/2009
JP 2014240636 A * 12/2014

*Primary Examiner* — Laert Dounis
(74) *Attorney, Agent, or Firm* — Morgan Lewis & Bockius LLP

(57) ABSTRACT

A fuel reforming system includes an engine combusting reformed gas to generate mechanical power; an intake line connected with the engine to supply the reformed gas and air to the engine; an exhaust line connected with the engine to circulate exhaust gas exhausted from the engine; a fuel reformer provided at an exhaust gas recirculation (EGR) line diverging from the exhaust line, mixing the exhaust gas passing through the EGR line with fuel and reforming the fuel mixed with the exhaust gas; a water temperature controller (WTC) provided at the engine to control coolant cooling the engine; a radiator for radiating a portion of heat generated from the engine to atmosphere through the coolant; a temperature sensor provided at the EGR line at a front end of the fuel reformer and measuring temperature of the exhaust gas at the front end of the fuel reformer; a coolant passage provided to connect an exit of the engine, the fuel reformer, the radiator, and an entrance of the engine in series; and a coolant supply control valve for supplying the coolant into an inside of the fuel reformer according to engine driving condition and temperature of the exhaust gas.

10 Claims, 2 Drawing Sheets

(51) Int. Cl.

| | |
|---|---|
| ***F02B 37/00*** | (2006.01) |
| ***F02M 26/33*** | (2016.01) |
| ***F02M 26/36*** | (2016.01) |
| ***F02M 26/04*** | (2016.01) |
| ***F02M 26/47*** | (2016.01) |
| ***F02M 26/02*** | (2016.01) |

(52) U.S. Cl.
CPC ..... *F02M 26/04* (2016.02); *F02M 26/36* (2016.02); *F01N 2240/02* (2013.01); *F01N 2240/30* (2013.01); *F01N 2240/36* (2013.01); *F01P 2060/16* (2013.01); *F02B 37/00* (2013.01); *F02M 26/47* (2016.02)

(56) References Cited

U.S. PATENT DOCUMENTS

2007/0183939 A1* 8/2007 Hotta ..... F02D 19/08 422/110
2010/0212611 A1* 8/2010 Yahagi ..... F02D 19/081 123/3
2010/0224141 A1* 9/2010 Nakada ..... F02D 19/0631 123/3
2010/0300382 A1* 12/2010 Yahagi ..... C01B 3/323 123/3
2012/0285400 A1* 11/2012 Inuzuka ..... F02D 41/04 123/3
2013/0025547 A1 1/2013 Nakagawa et al.
2013/0037235 A1* 2/2013 Sakabe ..... F01N 5/02 165/41
2013/0333639 A1* 12/2013 Hoshino ..... B01J 23/96 123/3
2014/0369890 A1 12/2014 Hirabayashi et al.
2015/0075451 A1* 3/2015 Inuzuka ..... F02D 41/0065 123/3
2017/0333843 A1* 11/2017 Aoyagi ..... C01B 3/38
2018/0328247 A1* 11/2018 Kim ..... F01N 3/2066

* cited by examiner

FUEL REFORMING SYSTEM AND CONTROL METHOD OF COOLANT SUPPLY

CROSS-REFERENCE TO RELATED APPLICATION

The present application is based on and claims the benefit of priority to Korean Patent Application No. 10-2017-0049811 filed on Apr. 18, 2017 with the Korean Intellectual Property Office, the entire contents of which are incorporated herein by reference.

TECHNICAL FIELD

The present disclosure relates to a fuel reforming system and control method of coolant supply. More particularly, the present disclosure relates to a fuel reforming system and control method of coolant supply which may supply or cut off coolant to a fuel reformer according to driving condition.

BACKGROUND

Hydrogen which is a material having most light and simple structure on earth has physical and chemical characteristic of about 6 times of laminar flame velocity and about three times of lower heating value compared with gasoline. Accordingly, during combusting by properly mixing gasoline and hydrogen, combustion speed and combustion stability may be increased to improve thermal efficiency by expanding lean boundary or increasing supply amount of exhaust gas recirculation.

Meanwhile, a fuel reformer is a system generating hydrogen. The hydrogen is generated by reacting separate gasoline fuel supplied to the reformer with a catalyst in the reformer using thermal energy of high temperature exhaust gas exhausted from an engine.

By the way, in a certain driving condition that the exhaust gas temperature is high, cooling the fuel reformer is necessary to prevent an injector in the fuel reformer from being overheated. For this, in a conventional technology, structure of the fuel reforming system is complicated and system cost and weight increases. Also, efficiency of the fuel reformer is influenced by temperature of catalyst in the fuel reformer, therefore means to control the coolant supplied to the fuel reformer for improving reforming efficiency in various driving conditions.

The above information disclosed in this Background section is only for enhancement of understanding of the background of the disclosure and therefore it may contain information that does not form the prior art that is already known in this country to a person of ordinary skill in the art.

SUMMARY

The present disclosure has been made in an effort to provide a fuel reforming system and control method of coolant supply which includes one coolant passage circulating an engine and a fuel reformer and may control coolant supply according to engine driving condition and exhaust gas temperature.

A fuel reforming system according to an exemplary embodiment of the present disclosure includes an engine combusting reformed gas to generate mechanical power; an intake line connected with the engine to supply the reformed gas and air to the engine; an exhaust line connected with the engine to circulate exhaust gas exhausted from the engine; a fuel reformer provided at an exhaust gas recirculation (EGR) line diverging from the exhaust line, mixing the exhaust gas passing through the EGR line with fuel and reforming the fuel mixed with the exhaust gas; a water temperature controller (WTC) provided at the engine to control coolant cooling the engine; a radiator for radiating a portion of heat generated from the engine to atmosphere through the coolant; a temperature sensor provided at the EGR line at a front end of the fuel reformer and measuring temperature of the exhaust gas at the front end of the fuel reformer; a coolant passage provided to connect an exit of the engine, the fuel reformer, the radiator, and an entrance of the engine in series; and a coolant supply control valve for supplying the coolant into an inside of the fuel reformer according to engine driving condition and temperature of the exhaust gas.

The WTC may be provided at a side of the exit of the engine.

The fuel reformer further may include a coolant entrance and a coolant exit which the coolant enters and exits the inside of the fuel reformer, and the coolant supply control valve configured to be opened or closed according to the engine driving condition and the temperature of the exhaust gas may be provided at the coolant entrance.

A fuel reforming system according to an exemplary embodiment of the present disclosure may further include a compressor connected with the intake line and compresses and supply the reformed gas and air to the engine; and a turbine connected with the exhaust line and rotated by the exhaust gas to generate power.

An EGR cooler cooling the reformed gas and an EGR valve disposed at a rear end of the EGR cooler and adjusting flow rate of the reformed gas may be installed at the EGR line.

The fuel reformer may be installed at a front portion of the EGR cooler in the EGR line.

The engine driving condition may be revolutions per minute of the engine and engine torque.

A control method of coolant supply according to an exemplary embodiment of the present disclosure is a control method of coolant supply of a fuel reformer mixing the EGR gas passing through the EGR line with the fuel and reforming the fuel mixed in the EGR gas, and includes detecting, by a controller, driving condition of an engine; determining, by the controller, whether or not the engine driving condition is in a reforming driving region; determining, by the controller, whether an exhaust gas temperature measured by a temperature sensor exceeds a target temperature if the engine driving condition is in the reforming driving region; and opening, by the controller, a coolant supply control valve of the fuel reformer to supply coolant into an inside of the fuel reformer if the exhaust gas temperature exceeds the target temperature.

The control method of coolant supply according to an exemplary embodiment of the present disclosure may further include cutting off, by the controller, the coolant supply into the inside of the fuel reformer by closing the coolant supply control valve of the fuel reformer if the exhaust gas temperature is below the target temperature.

The engine driving condition may be revolutions per minute of the engine and engine torque.

According to an exemplary embodiment of the present disclosure, in a low speed/low torque driving condition, reforming efficiency may be improved by cutting off coolant supply into the fuel reformer.

Moreover, in a high speed/high torque driving condition, malfunction of the fuel reforming system through overheating of a fuel injector in the fuel reformer may be prevented by supplying coolant supply into the fuel reformer.

DETAILED DESCRIPTION

Figure 1:
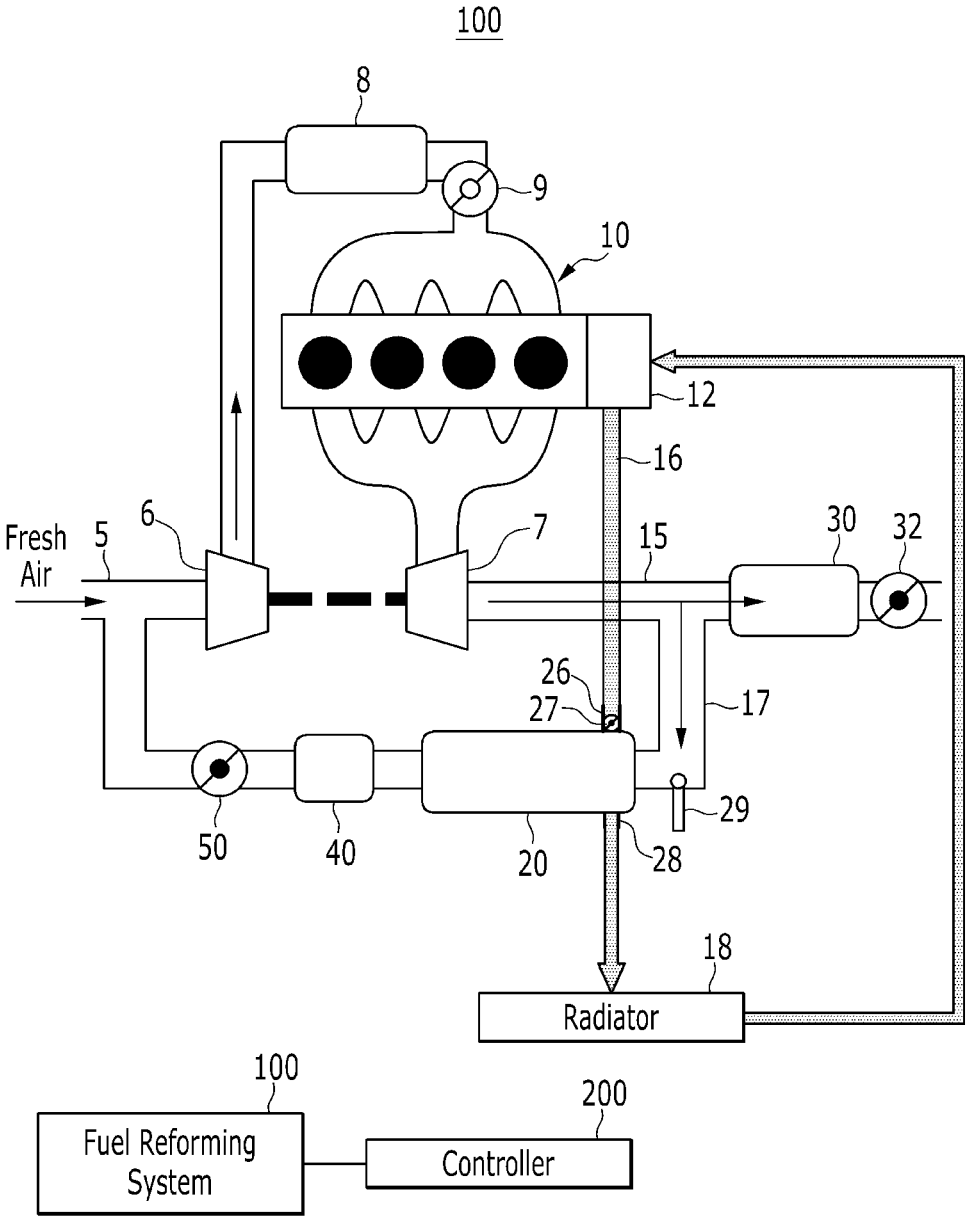
FIG. 1 is a schematic view illustrating a fuel reforming system according to an exemplary embodiment of the present disclosure.

Hereinafter, the present invention will be described more fully with reference to the accompanying drawings, in which exemplary embodiments of the invention are shown. As those skilled in the art would realize, the described embodiments may be modified in various different ways, all without departing from the spirit or scope of the present invention.

Further, in exemplary embodiments, since like reference numerals designate like elements having the same configuration, a first exemplary embodiment is representatively described, and in other exemplary embodiments, only configurations different from the first exemplary embodiment will be described.

The drawings are schematic, and are not illustrated in accordance with a scale. Relative dimensions and ratios of portions in the drawings are illustrated to be exaggerated or reduced in size for clarity and convenience, and the dimensions are just exemplified and are not limiting. In addition, same structures, elements, or components illustrated in two or more drawings use same reference numerals for showing similar features. It will be understood that when an element such as a layer, film, region, or substrate is referred to as being "on" another element, it can be directly on the other element or intervening elements may also be present.

The exemplary embodiment of the present disclosure shows an exemplary embodiment of the present disclosure in detail. As a result, various modifications of the drawings will be expected. Therefore, the exemplary embodiment is not limited to a specific aspect of the illustrated region, and for example, includes modifications of an aspect by manufacturing.

Now, a fuel reforming system according to an exemplary embodiment of the present disclosure will be described with reference to FIG. 1.

FIG. 1 is a schematic view illustrating a fuel reforming system according to an exemplary embodiment of the present disclosure.

Referring to FIG. 1, a fuel reforming system 100 includes an engine 10, an intake line 5, an exhaust line 15, a fuel reformer 20, a water temperature controller (WTC) 12, a radiator 18, a temperature sensor 29, a coolant passage 16 and a coolant supply control valve 27.

The engine 10 burns air/fuel mixture in which fuel and air are mixed so as to convert chemical energy into mechanical energy. The engine 10 is connected to an intake manifold so as to receive the air in a combustion chamber, and is connected to an exhaust manifold such that exhaust gas generated in combustion process is gathered in the exhaust manifold and is exhausted to the exterior. An injector is mounted in the combustion chamber so as to inject the fuel into the combustion chamber.

The intake line 5 is connected with entrance of the engine 10 to supply reformed gas and air to the engine 10, and the exhaust line 15 is connected with exit of the engine 10 to circulate exhaust gas exhausted from the engine 10.

A portion of the exhaust gas exhausted from the engine 10 is supplied to the engine 10 through an exhaust gas recirculation (EGR) line 17. Also, the EGR line 17 is connected with the intake manifold of the engine 10 so that combustion temperature is controlled by mixing a portion of the exhaust gas with air. This combust temperature control is conducted by adjusting exhaust gas amount supplied to the intake manifold. Accordingly, an EGR valve 50 adjusting flow rate of the reformed gas may be installed at the EGR line 17.

An exhaust gas recirculation system realized by the EGR line 17 supplies a portion of the exhaust gas to the intake system and inflows to combustion chamber when exhaust amount of the nitrogen oxide needs to be reduced according to driving condition. Then, the exhaust gas that is inert gas which volume is not changed depresses density of the air/fuel mixture and flame transmitting speed is reduced during combustion of the fuel. Therefore, combustion velocity of the fuel is reduced and raise of the combustion temperature is reduced to depress generation of the nitrogen oxide.

The fuel reformer 20 is disposed at the EGR line 17 diverging from the exhaust line 15 and mixes the exhaust gas inflowing from the EGR line 17 with fuel to reform the fuel mixed with the exhaust gas.

The fuel reformer 20 may include an entrance into which the exhaust gas inflows, a mixing portion which the exhaust gas and fuel are mixed, a reforming portion reforming the fuel, and an exit from which the exhaust gas outflows.

An EGR cooler 40 cooling reformed gas passing through the engine 10 and the fuel reformer 20 may be provided at the EGR line 17. The EGR cooler 40 may be provided at a rear end of the fuel reformer 20 and integrally provided with the fuel reformer 20.

The WTC 12 is provided at the engine 10 and controls temperature of coolant cooling the engine 10. The WTC 12 may be provided at a side of the engine exit.

The radiator 18 radiates a portion of heat generated from the engine 10 to atmosphere through the coolant. The radiator 18 is a device radiating a portion of heat generated from the internal combustion engine to atmosphere through the coolant. The radiator 18 transmits high temperature coolant into a thin pipe and passes air to space between the pipe by a cooling fan to cool the coolant.

The coolant passage 16 may be provided to connect an exit of the engine 10, the fuel reformer 20, the radiator 18 and an entrance of the engine 10 in series, and the coolant may be circulated through the engine 10, the WTC 12, the fuel reformer 20, and the radiator 18.

The temperature sensor 29 is provided at the EGR line 17 at a front end of the fuel reformer 20 and measures temperature of the exhaust gas at the front end of the fuel reformer 20.

The coolant supply control valve 27 supplying the coolant into an inside of the fuel reformer 20 according to engine driving condition and the exhaust gas temperature measured by the temperature sensor 29 of the exhaust gas is provided at the front end of the fuel reformer 20. At this time, the engine driving condition may be revolutions per minute (RPM) of the engine 10 and engine torque.

The fuel reformer 20 includes a coolant entrance 26 and a coolant exit 28 which the coolant enters and exits the inside, and the coolant supply control valve 27 may be provided at the coolant entrance 26.

The fuel reforming system 100 according to an exemplary embodiment of the present disclosure may further include a compressor 6 connected with the intake line 5 and compresses the reformed gas and air to supply to the engine 10, and a turbine 7 connected with the exhaust line 15 and rotates by the exhaust gas to generate power.

The fuel reforming system 100 may include an intercooler 8 connected with the compressor 6 and cooling air and reformed gas flowed into the intake line 5 of the engine 10 again, and a throttle valve 9 adjusting flow rate of the air and reformed gas.

An exhaust gas pressure control valve 32 adjusting flow rate of the exhaust gas may be provided in the exhaust line 15 at a rear end of a catalyst 30 purifying nitrogen oxide included in the exhaust gas.

The EGR valve 50 provided at a rear end of the EGR cooler 40 and adjusting flow rate of the reformed gas may be installed in the EGR line 17.

Coolant supply into the fuel reformer 20 of the fuel reforming system 100 may be controlled by a controller 200, which is an electric circuitry that executes instructions of software which thereby performs various functions described hereinafter.

Figure 2:
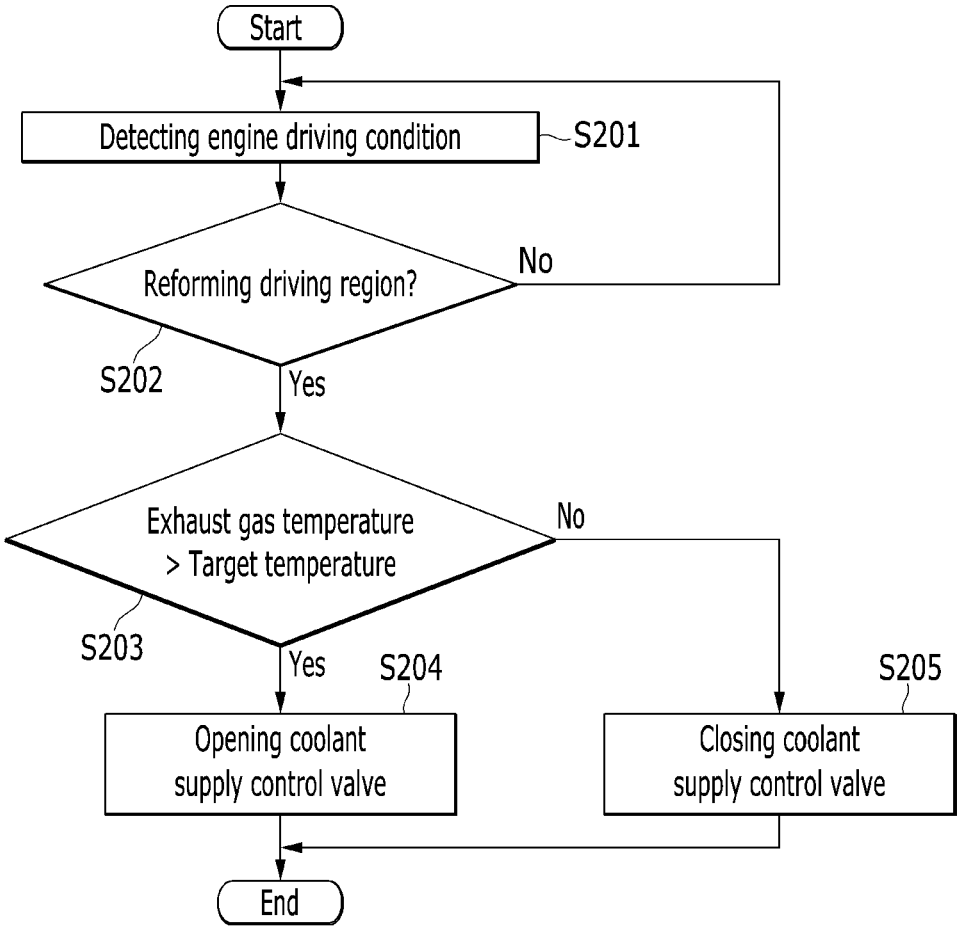
FIG. 2 is a flowchart illustrating a control method of coolant supply according to an exemplary embodiment of the present disclosure.

FIG. 2 is a flowchart illustrating a control method of coolant supply according to an exemplary embodiment of the present disclosure.

Referring to FIG. 2, in a control method of coolant supply according to an exemplary embodiment of the present disclosure, firstly, driving condition of an engine is detected (S201). The driving condition of the engine may be the RPM of the engine, engine torque, idle state, normal speed, deceleration, and acceleration etc.

Then, whether or not the engine driving condition is in a reforming driving region is determined (S202). For example, as the RPM of the engine and the engine torque increase, the exhaust gas temperature of the engine is high. Therefore, the catalyst temperature of the fuel reformer becomes high. High efficiency operation of the fuel reformer is possible in a region that the catalyst of the fuel reformer is in a high temperature region. Reforming driving region is determined in advance by considering the engine speed and the engine torque, and whether the engine driving condition is in a predetermined region is determined.

Then, the exhaust gas temperature is measured by the temperature sensor provided at the EGR line at the front end of the fuel reformer, and whether exhaust gas temperature measured by a temperature sensor exceeds a target temperature is determined if the engine driving condition is in the reforming driving region (S203).

The target temperature is a value set in advance by experiment, and may be predetermined as a temperature which an injector is overheated to be out of order.

Then, a coolant supply control valve of the fuel reformer is opened to supply coolant into inside of the fuel reformer if the exhaust gas temperature exceeds the target temperature (S204). The coolant supply into the inside of the fuel reformer is cut off by closing the coolant supply control valve of the fuel reformer if the exhaust gas temperature is below the target temperature (S205).

As describe above, in a low speed/low torque driving condition, reforming efficiency may be improved by cutting off coolant supply into the fuel reformer. Further, in a high speed/high torque driving condition, malfunction of the fuel reforming system through overheating of a fuel injector in the fuel reformer may be prevented by supplying coolant supply into the fuel reformer.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A fuel reforming system, comprising:

an engine combusting reformed gas to generate mechanical power;

an intake line connected with the engine to supply the reformed gas and air to the engine;

an exhaust line connected with the engine to circulate exhaust gas exhausted from the engine;

a fuel reformer provided at an exhaust gas recirculation (EGR) line diverging from the exhaust line, mixing the exhaust gas passing through the EGR line with fuel and reforming the fuel mixed with the exhaust gas;

a water temperature controller (WTC) provided at the engine to control coolant cooling the engine;

a radiator for radiating a portion of heat generated from the engine to the atmosphere through the coolant;

a temperature sensor provided at the EGR line at an upstream end of the fuel reformer and measuring temperature of the exhaust gas at the upstream end of the fuel reformer;

a coolant passage provided to connect an exit of the engine, the fuel reformer, the radiator, and an entrance of the engine in series; and a coolant supply control valve for supplying the coolant into an inside of the fuel reformer according to engine driving condition and temperature of the exhaust gas.

2. The fuel reforming system of claim 1, wherein:

the WTC is provided at a side of the exit of the engine.

3. The fuel reforming system of claim 1, wherein:

the fuel reformer further includes a coolant entrance and a coolant exit which the coolant enters and exits the inside of the fuel reformer, and the coolant supply control valve configured to be opened or closed according to the engine driving condition and the temperature of the exhaust gas is provided at the coolant entrance.

4. The fuel reforming system of claim 1, further comprising:

a compressor connected with the intake line and compresses and supplies the reformed gas and air to the engine; and a turbine connected with the exhaust line and rotated by the exhaust gas to generate power.

5. The fuel reforming system of claim 1, wherein:

an EGR cooler cooling the reformed gas, and an EGR valve disposed at a downstream end of the EGR cooler and adjusting a flow rate of the reformed gas are installed at the EGR line.

6. The fuel reforming system of claim 5, wherein:

the fuel reformer is installed at an upstream portion of the EGR cooler in the EGR line.

7. The fuel reforming system of claim 1, wherein:

the engine driving condition is revolutions per minute of the engine and engine torque.

8. A control method of coolant supply of a fuel reformer mixing exhaust gas recirculation (EGR) gas passing through an EGR line of an engine with a fuel and reforming the fuel mixed in the EGR gas, comprising, detecting, by a controller, an engine driving condition;

determining, by the controller, whether or not the engine driving condition is in a reforming driving region;

determining, by the controller, whether an exhaust gas temperature measured by a temperature sensor exceeds a target temperature if the engine driving condition is in the reforming driving region; and opening, by the controller, a coolant supply control valve provided in a coolant passage of the fuel reformer to supply coolant into an inside of the fuel reformer if the exhaust gas temperature exceeds the target temperature, wherein the engine comprises a radiator for radiating a portion of heat generated from the engine to the atmosphere through the coolant;

wherein the coolant passage connects an exit of the engine, the fuel reformer, the radiator, and an entrance of the engine in series.

9. The control method of coolant supply of claim 8, further comprising:

cutting off, by the controller, the coolant supply into the inside of the fuel reformer by closing the coolant supply control valve of the fuel reformer if the exhaust gas temperature is below the target temperature.

10. The control method of claim 8, wherein:

the engine driving condition is revolutions per minute of the engine and engine torque.

* * * * *